US011060788B2

(12) United States Patent
Lindel et al.

(10) Patent No.: US 11,060,788 B2
(45) Date of Patent: Jul. 13, 2021

(54) HOUSEHOLD REFRIGERATION APPLIANCE WITH A DOOR STOP BAR HAVING A HEATING LINE THERMALLY COUPLED THERETO BY A HEAT CONDUCTING TRANSMISSION MEDIUM

(71) Applicant: BSH HAUSGERAETE GMBH, Munich (DE)

(72) Inventors: Andreas Lindel, Heidenheim (DE); Michael Krapp, Nattheim (DE); Thomas Bischofberger, Kisslegg (DE)

(73) Assignee: BSH Hausgeraete GmbH, Munich (DE)

( * ) Notice: Subject to any disclaimer, the term of this patent is extended or adjusted under 35 U.S.C. 154(b) by 382 days.

(21) Appl. No.: 15/833,014

(22) Filed: Dec. 6, 2017

(65) Prior Publication Data

US 2018/0156520 A1 Jun. 7, 2018

(30) Foreign Application Priority Data

Dec. 7, 2016 (DE) ..... 102016224385.3

(51) Int. Cl.
*F25D 23/06* (2006.01)
*F25D 11/00* (2006.01)
(Continued)

(52) U.S. Cl.
CPC ..... *F25D 23/069* (2013.01); *F25D 11/00* (2013.01); *F25D 21/04* (2013.01); *F25D 23/003* (2013.01);
(Continued)

(58) Field of Classification Search
CPC .... F25D 11/00; F25D 21/04; F25D 2323/021; F25D 23/003; F25D 23/02; F25D 23/028;
(Continued)

(56) References Cited

U.S. PATENT DOCUMENTS 5,638,694 A * 6/1997 Banicevic ..... F25D 21/04 62/277
6,036,294 A * 3/2000 Banicevic ..... F25D 23/069 312/296
(Continued)

FOREIGN PATENT DOCUMENTS

CN 201795656 U 4/2011
CN 202126131 U 1/2012
(Continued)

OTHER PUBLICATIONS

"Bottom": https://www.merriam-webster.com/dictionary/bottom: Accessed Aug. 2020.*

*Primary Examiner* — Tavia Sullens
(74) *Attorney, Agent, or Firm* — Laurence A. Greenberg; Werner H. Stemer; Ralph E. Locher

(57) ABSTRACT

A household refrigeration appliance has a housing in which there is embodied a receiving space for foodstuffs, a first door and a second door separate therefrom. The doors closing a front-side receiving opening of the receiving space to the front. A door stop bar is disposed externally to the doors which is arranged in the receiving opening and is connected by a first end to a first boundary wall and by a second end to a second boundary wall. Wherein in the closed state the doors abut against the door stop bar on the front side, and have a frame heating which is arranged on the door stop bar for the purpose of heating the door stop bar. A heating line of the frame heating is arranged behind a front panel of the door stop bar and is thermally coupled to the front panel by the heat-conducting transmission medium.

19 Claims, 6 Drawing Sheets

(51) Int. Cl.
*F25D 21/04* (2006.01)
*F25D 23/00* (2006.01)
*F25D 23/02* (2006.01)

(52) U.S. Cl.
CPC ..... *F25D 23/02* (2013.01); *F25D 23/028* (2013.01); *F25D 2323/021* (2013.01); *F25D 2400/04* (2013.01); *F25D 2400/06* (2013.01)

(58) Field of Classification Search
CPC . F25D 23/069; F25D 2400/06; F25D 2400/02
See application file for complete search history.

(56) References Cited

U.S. PATENT DOCUMENTS

| | | | | |
|---|---|---|---|---|
| 6,428,130 | B1 * | 8/2002 | Banicevic | F25D 21/04 312/296 |
| 2009/0044556 | A1 | 2/2009 | Ihle | |
| 2017/0016271 | A1 * | 1/2017 | Boucher | F25D 23/028 |

FOREIGN PATENT DOCUMENTS

| | | | |
|---|---|---|---|
| CN | 202158715 | U | 3/2012 |
| CN | 106016893 | A | 10/2016 |
| DE | 29504901 | U1 | 5/1995 |
| DE | 102005021590 | A1 | 11/2006 |
| WO | 2008066542 | A1 | 6/2008 |

* cited by examiner

HOUSEHOLD REFRIGERATION APPLIANCE WITH A DOOR STOP BAR HAVING A HEATING LINE THERMALLY COUPLED THERETO BY A HEAT CONDUCTING TRANSMISSION MEDIUM

CROSS-REFERENCE TO RELATED APPLICATION

This application claims the benefit, under 35 U.S.C. § 119, of German patent application DE 10 2016 224 385.3, filed Dec. 7, 2016; the prior application is herewith incorporated by reference in its entirety.

BACKGROUND OF THE INVENTION

Field of the Invention

The invention relates to a household refrigeration appliance having a housing in which there is embodied a receiving space for foodstuffs. The household refrigeration appliance has a first door and a second door separate therefrom, the doors closing a front-side receiving opening of the receiving space to the front. The household refrigeration appliance additionally has a door stop bar disposed externally to the doors which is arranged in the receiving opening and is connected by a first end to a first boundary wall delimiting the receiving opening, and by a second end to a second boundary wall delimiting the receiving opening. In the closed state, the two doors abut against the door stop bar on the front side. The household refrigeration appliance also has a frame heating arrangement which is disposed on the door stop bar for the purpose of heating the door stop bar.

A corresponding household refrigeration appliance is known from international patent disclosure WO 2008/066542 A1. There, the vertical door stop bar or mullion disposed externally to the doors is screwed to the boundary walls both at its upper end and at its lower end by a plurality of separate screws in each case. In this arrangement, the screws are screwed into the upper and the lower boundary wall in the vertical direction, and hence with their screw shafts parallel to the extension of the door stop bar. An embodiment of this type is technically highly complicated in terms of its assembly. Furthermore, the completely vertical orientation of the door stop bar is achievable only with difficulty. This leads to the closing behavior of the doors being restricted in the event of a door stop bar that is tilted forward at the upper end or at the lower end in the depth direction of the household refrigeration appliance and/or of a door stop bar that is rotated outward about its longitudinal axis and/or in the event of a door stop bar that is inclined sideways at an angle at the upper end or at the lower end in a vertical position in the width direction of the household refrigeration appliance. In particular, a complete closing, and thus a sealing engagement of one or both doors against the door stop bar, may be prevented. An unwanted introduction of heat into the receiving space by way of the interface may occur as a result. This also leads to a disadvantageous mode of operation in terms of energy consumption.

A household refrigeration appliance of said type is known from published, non-prosecuted German patent application DE 10 2005 021 590 A1, wherein in that instance the door stop bar is not arranged in a fixed position on the walls, but is coupled to the two pivotable doors and is co-pivoted with these. In the embodiment of the frame heating disclosed therein, the latter is incorporated in the door stop bar and embodied as a Peltier element. Facing toward the doors in that arrangement, a ferromagnetic plate is embedded in a separating body which is formed from a heat-insulating material. The ferromagnetic plate is not part of the frame heating. The frame heating is arranged with a first ceramic plate directly in the rear side of the ferromagnetic plate and consequently is in contact with the latter. The second ceramic plate of the Peltier element is spaced apart therefrom and positioned at a distance from the first ceramic plate in the separating body, semiconductor pieces extending between the ceramic plates. An embodiment of the frame heating of this type is very complex in terms of its structure and furthermore results in the separating body being embodied as not thermally insulated over its entire depth in a certain region. This has substantial detrimental consequences in respect of the thermal insulating effect of the separating body. Furthermore, the frame heating is not only very complicated in its embodiment as a Peltier element, but also takes up a great deal of space.

In addition, German utility model DE 295 04 901 U1 discloses a refrigeration appliance in which a frame heating arrangement is embodied on the front side, not in a door stop bar, but in an integrated bottom wall which is embodied in an inner container and separates a refrigerator compartment from a freezer compartment. Tubular heating lines are laid in the frame heating arrangement. The heating line is arranged behind a separate front panel which is embodied as a front plate. The heating line is nonetheless arranged spaced at a distance from the front strip and an air space is embodied therebetween. On the rear side facing away from the front strip, the heating line is arranged embedded in sections in a sealing compound. The sealing compound is embodied in a recess of a plastic inner lining.

In this embodiment, the transfer of heat from the frame heating to the front strip is likewise restricted, with the result that the heating effect at the front side can only be achieved to a limited extent.

SUMMARY OF THE INVENTION

It is the object of the present invention to create a household refrigeration appliance in which the targeted transfer of heat to a front side of a door stop bar external to the doors is improved and the thermal insulating effect of the door stop bar is high.

A household refrigeration appliance according to the invention contains a housing in which there is embodied at least one receiving space for foodstuffs. The household refrigeration appliance furthermore contains a first door and a second door separate therefrom. The two doors close a receiving opening of the receiving space on the front side. In addition, the household refrigeration appliance has a door stop bar disposed externally to the doors, which door stop bar is therefore not arranged on the door itself and which, in the case of a movement of at least one door relative to the housing, does not move together with the door or doors, but always remains in a fixed position on the housing in the region of the receiving opening. The door stop bar is arranged in the plane of the receiving opening. The receiving or loading opening of the receiving space is therefore separated into two partial openings by the door-external door stop bar. The door stop bar is connected by a first end to a first boundary wall delimiting the receiving opening, and by a second end to a second boundary wall delimiting the receiving opening. In the closed state of the doors, the two doors abut against the door stop bar on the front side and thus engage with the door stop bar on the front side facing away from the receiving space. The door stop bar is a separate component from the inner container, the inner container delimiting the receiving space with its boundary walls. The household refrigeration appliance additionally has a frame heating arrangement which is disposed on the door stop bar for the purpose of heating the door stop bar. A fundamental idea of the invention is to be seen in the fact that the frame heating has a heating line, which is therefore in particular a tubular conduit, the heating line being arranged behind a front panel of the door stop bar in the depth direction of the household refrigeration appliance and being thermally coupled to the front panel by a heat-conducting transmission medium that is separate from the front panel and the heating line and is embodied from a solid material. By such an embodiment there is, particularly in the case of quite specific household refrigeration appliances, namely those in which a contiguous receiving space with its associated front-side receiving opening can be closed by two separate doors which abut against the beam-like or strip-shaped door-external door stop bar, a quite specific and improved transfer of heat to a front panel of the door stop bar. The invention enables a quite targeted and defined transfer of heat to the front-side front panel to be made possible by the placement of the heat-conducting transmission medium intermediately between the front panel and the heating line. By a directionally targeted transfer of heat, an improved transfer of heat is also achieved as a result. Then again, an embodiment of this type allows the frame heating to be implemented in a particularly simple and compact design, such that on the other hand the door stop bar is furthermore also embodied in this respect in a highly functional manner in terms of its thermal insulating effect toward the receiving space.

Preferably it is provided that the heat-conducting transmission medium is a deformable medium. This enables an individual deformation to be made possible during assembly, such that bearing surfaces of the transmission medium can be coupled with particularly large coverage to the front panel on the one hand and the heating line on the other hand. A particularly efficient thermal coupling with a particularly high heat transfer is made possible as a result.

Preferably it is provided that the heating line is embedded at least in sections in the transmission medium. The transfer of heat is improved further as a result of such an embodiment and in addition a certain retaining function of the transmission medium for retaining the heating line is achieved. The transmission medium is also a multifunctional component of the door stop bar as a result.

It is advantageously provided that the heating line is arranged embedded in the heat-conducting transmission medium over at least half of the diameter of the heating line on a side facing toward a front plate of the front panel. The above-cited advantages are achieved here in a way that is to be particularly highlighted. Furthermore, a particularly compact design is then also made possible, especially in the depth direction, which compact design also permits the thermal insulation material of the door stop bar then following toward the rear in the depth direction toward the receiving space to be dimensioned particularly generously.

Preferably it is provided that the transmission medium is embodied as adhesive tape, in particular as double-sided adhesive tape. In addition to the heat-conducting function, a particularly simple fixing requiring no additional separate fastening means such as screws or the like is also achieved in this way. In addition, it is then made possible both that the transmission medium can easily be adhesively bonded to the inside face of the front panel and that on the other hand the heating line can be easily pressed in and arranged in a permanently positionally stable manner on the transmission medium. In this case no additional further separate fastening devices are required for fixing the transmission medium to the heating line.

It is advantageously provided that the transmission medium contains butyl, in particular is embodied to at least 50 percent from butyl. In the present context butyl is a particularly advantageous material which on the one hand possesses the desired thermal conductivity and on the other hand then additionally also simultaneously has the adhesive fastening and retaining capability.

Preferably it is provided that a foil, in particular a metal foil, is attached on a rear side of the transmission medium facing away from the front panel. This has advantages in relation to the fastening on the side facing away from the front panel, in particular also during the installation of the heating line. In this embodiment it can then also be provided that the heating line is then thermally coupled to the transmission medium by way of the intermediate foil. The foil is in particular a metal foil, preferably an aluminum foil.

In particular, the front panel of the door stop bar is embodied at least in sections, in particular in its entirety, from metal. In the first place this makes it stable, and in a particularly advantageous way the transfer of heat toward the exterior is therefore then possible, such that that surface of the front panel and consequently the surface facing toward the doors can be heated sufficiently in order then also thus to avoid unwanted condensation there.

The front panel with its metallic embodiment is also advantageous when the two doors are embodied with magnetic door seals, by which they then abut against the front side of the front panel, in particular also engage to a certain extent in a magnetically secured manner when they are closed. What is also achieved by the door stop bar is that no unwanted introduction of heat into the receiving space takes place in a gap between the two doors.

Preferably it is provided that the front panel is embodied like a channel or trough in cross-section, in particular is embodied as C-shaped, and the transmission medium and the heating line are arranged in the cavity formed by the C shape. A very compact structure is likewise achieved by this embodiment, and the transmission medium and the heating line are positioned in a protected and countersunk manner. A positionally secure installation is made possible in this way.

Preferably it is provided that the door stop bar is embodied in multiple parts and in addition to the front panel has a thermal insulating body separate therefrom on which the front panel is arranged. By such a multipart design, the assembly specifically also of the transmission medium and the heating line can be realized particularly easily, such that in this case also a concealed installation of the components in the door stop bar is then made easily possible. In particular, it can be provided that the front panel is fixed and/or screwed to the thermal insulating body.

In an advantageous embodiment it is provided that the thermal insulating body has a first bar member and a second bar member, separate therefrom, which is connected to the first bar member and together with the first bar member delimits a cavity into which a thermally insulating material is introduced. By an embodiment of this type, the functionality of the door stop bar can be configured also to a particular extent such that, when viewed in the depth direction, a sufficiently large area is embodied behind the front panel and behind the transmission medium, as well as behind the heating line also, and therefore located closer to the receiving space, which area enables a thermal insulating effect of the door stop bar toward the receiving space.

Preferably it is provided that the bar members are embodied from plastic. This enables them to be produced in a particularly weight-saving manner and each can also be manufactured for example in one piece as an injection-molded part.

Preferably it is provided that the front panel is arranged at least in sections in an immersed manner in a front-side receptacle of the insulating body. What is achieved by this embodiment is on the one hand a compact design of the door stop bar, and on the other hand a positionally secure arrangement of the front panel relative to the insulating body. By this embodiment there is furthermore created between the front panel and the insulating body a receiving space in which the transmission medium and the heating line can be arranged in a secure and protected manner. In particular it is provided that the heating line is arranged in non-contacting relationship to the insulating body, in particular that an air space is formed between the heating line and the insulating body. Thus, the heating line is arranged on the side facing away from the transmission medium, and therefore also facing away from the front plate of the front panel, and is separated from the insulating body by use of an air space.

Preferably it is provided that the door stop bar extends in the depth direction of the household refrigeration appliance to a depth of less than or equal to 12 cm, in particular of less than or equal to 10 cm. The beam-shaped door stop bar is then constructed in a very compact manner in the present context, such that no undesirable installation space that would limit the receiving space is required toward the rear. It can be provided that the receiving space is embodied free of interruption, and therefore contiguously, behind the door stop bar, and consequently the receiving space is configured as a refrigerator compartment or a freezer compartment. It can also be provided that a partition plate that is separate from the door stop bar and from the inner container is arranged in the depth direction of the household refrigeration appliance behind the door stop bar and at the same level as the door stop bar when viewed in the height direction of the household refrigeration appliance. As a result, a volume separation is created in a single, continuous receiving space by the partition plate and the door stop bar, and furthermore a front-side separation of the entire contiguous area of the receiving opening into two partial openings of the volume of the receiving space then located therebehind in each case in the depth direction likewise into two partial volumes is achieved. It is then possible that identical storage conditions are realized in the receiving space in the partial volume, and in particular an additional lower shelf is formed by the partition plate. The partition plate can be a glass plate, for example. In an advantageous embodiment it is provided that one of the two partial volumes of the receiving space formed by the separate partition plate is formed as a storage area which enables different storage conditions to be set compared to the other storage area of the receiving space, in particular a different humidity and/or a different temperature. For example, one of the two partial volumes of the receiving space can then be embodied as a keep-fresh zone, in which for example fruit or vegetables can then be kept fresh for longer, in that a different humidity and/or a different temperature from the other partial volume of the receiving space is set.

In addition and alternatively thereto, it can be provided that the household refrigeration appliance has a freezer compartment as receiving space, which is likewise embodied according to the above-described invention or an advantageous embodiment thereof. It can be provided that the door stop bar is oriented vertically or horizontally. It is also possible that a household refrigeration appliance is embodied with two separate receiving spaces, which are therefore also thermally insulated from one another and are embodied for example on the one hand as a refrigerator compartment and on the other hand as a freezer compartment. Both such compartments can then have a respective door stop bar in each case in the region of their receiving openings.

The positions and orientations given in the case of proper use and arrangement of the appliance as intended, and with an observer then standing in front of the appliance and looking in the direction of the appliance, are specified by indicators such as "top", "bottom", "front", "rear, "horizontal", "vertical", "depth direction", "width direction", "height direction", etc.

When reading the claim language, the following definitions apply. When the claim language recites A and/or B it means A alone, B alone or A and B. When the claim language recites at least one of A and B it means A alone, B alone or A and B. When the claim language recites at least one of A or B it means A alone, B alone or A and B.

Further features of the invention will become apparent from the claims, the figures and the description of the figures. The features and feature combinations cited hereinabove in the description, as well as the features and feature combinations cited hereinbelow in the description of the figures and/or shown solely in the figures can be used not only in the combination specified in each case, but also in other combinations, without departing from the scope of the invention. It is therefore also appropriate to consider embodiments of the invention as incorporated and disclosed which are not explicitly shown in the figures and explained, yet which may be derived and produced by separated feature combinations from the embodiments that have been explained. Embodiments and feature combinations which therefore do not exhibit all of the features of an originally formulated independent claim are also to be regarded as disclosed. Furthermore, embodiments and feature combinations, in particular based on the above-described embodiments, are to be regarded as disclosed which go beyond or diverge from the feature combinations set forth in the back-references of the claims.

Other features which are considered as characteristic for the invention are set forth in the appended claims.

Although the invention is illustrated and described herein as embodied in a household refrigeration appliance with a door stop bar having a heating line thermally coupled thereto by means of a heat conducting transmission medium, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

In the figures, like or functionally equivalent elements are labeled with the same reference signs.

DETAILED DESCRIPTION OF THE INVENTION

Figure 1:
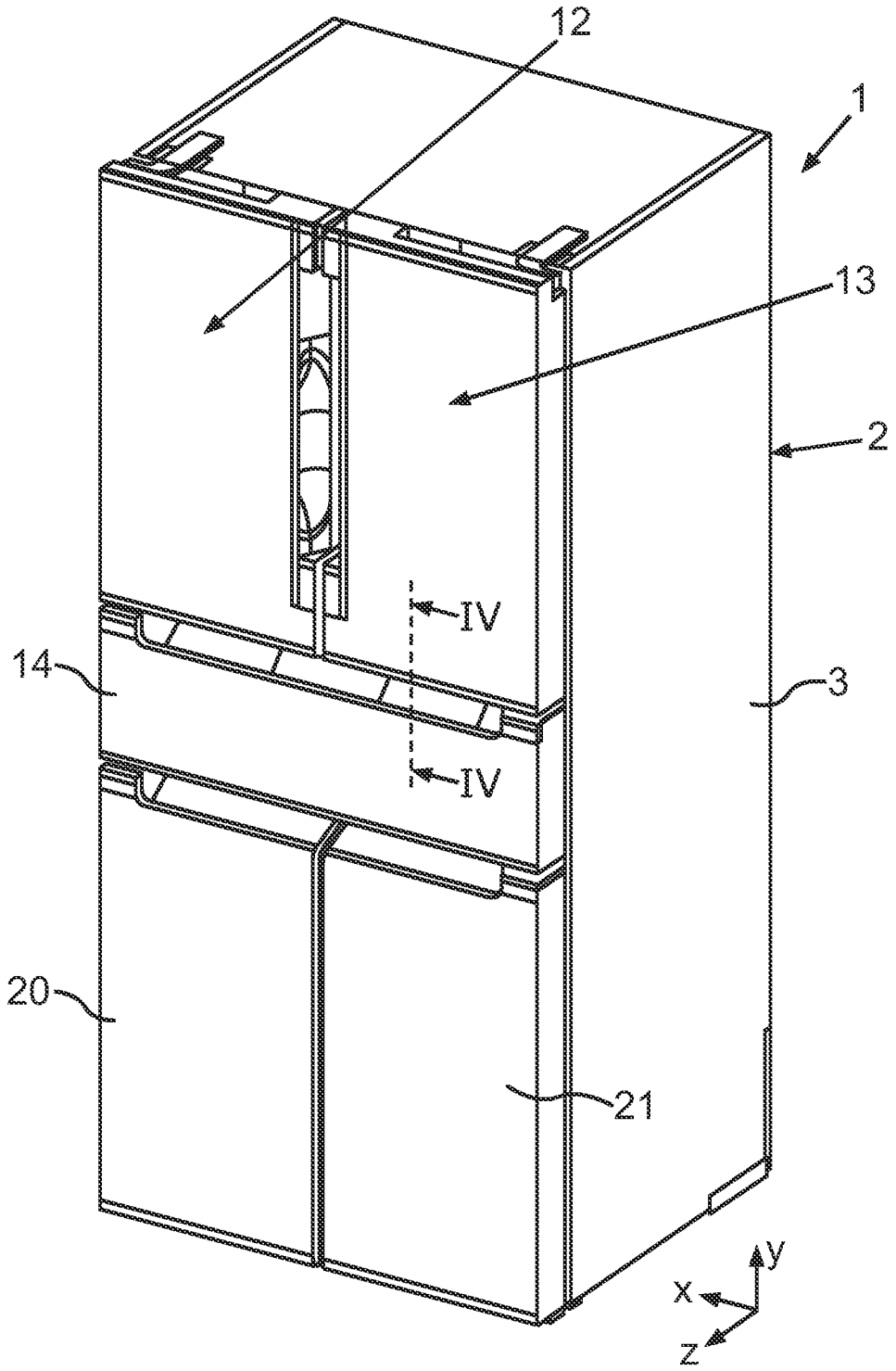
FIG. 1 is a diagrammatic, perspective view of an exemplary embodiment of a household refrigeration appliance according to the invention.
Figure 2:
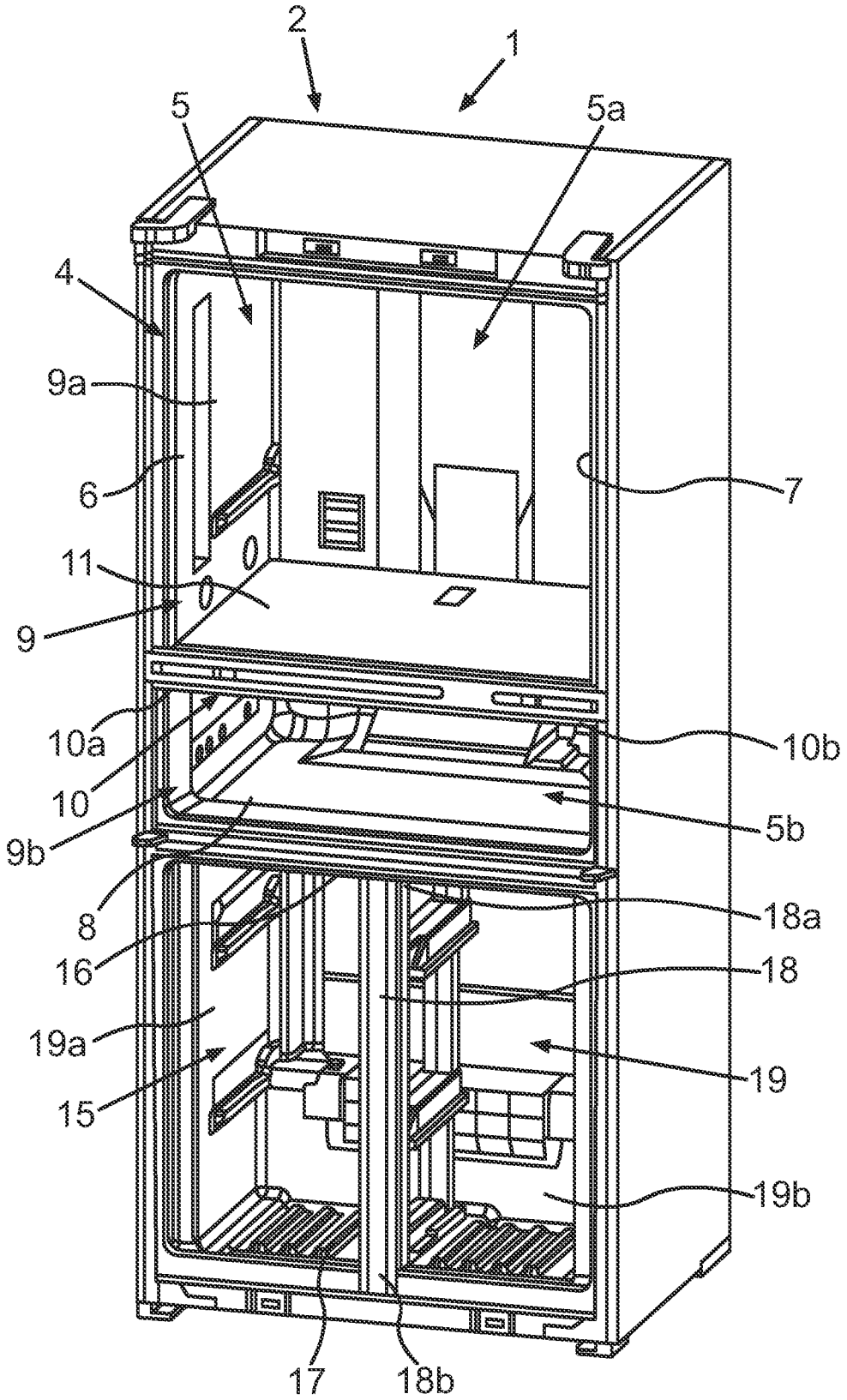
FIG. 2 is a perspective view of the household refrigeration appliance according to FIG. 1 with doors removed from the housing so as to allow a view into the respective receiving spaces.

Referring now to the figures of the drawings in detail and first, particularly to FIG. 1 thereof, there is shown a household refrigeration appliance 1, which may be embodied as a refrigerator or freezer, in an exemplary representation. In the exemplary embodiment, the household refrigeration appliance 1 is configured as a combined fridge-freezer and is embodied for the purpose of storing and conserving foodstuffs. The household refrigeration appliance 1 has a housing 2 having an outer housing 3, in which at least one inner container 4 (FIG. 2) is arranged. As can be seen in the illustration according to FIG. 2, in which doors (that are yet to be designated more precisely) of the household refrigeration appliance 1 are removed, the household refrigeration appliance 1 has a first receiving space 5 which is delimited by walls of the inner container 4. In the exemplary embodiment, the first receiving space 5 is a refrigerator compartment. The first receiving space 5 is delimited by two oppositely disposed boundary walls 6 and 7, which are vertical side walls. The receiving space 5 is additionally delimited by a top wall, a rear wall and a bottom wall, the bottom wall 8 being designated more precisely in this case.

On the front side, the receiving space 5 has a loading or receiving opening 9 which typically is embodied contiguously, without interruption, so as to allow unrestricted access to the first receiving space 5 on the front side, and which therefore represents the entrance or the entrance plane.

In the illustrated exemplary embodiment it is provided that a door-external, beam-like door stop bar 10 is arranged in the receiving opening 9, and therefore in the vertical plane of the receiving opening 9, which door stop bar 10 therefore extends in the width direction (x-direction) and is connected by a first end 10*a* to the boundary wall 6, and by a second end 10*b* to the boundary wall 7. The separate door stop bar 10 is arranged in a fixed position on the housing 2 and therefore is not coupled in moving relationship with doors that can be pivoted relative to the housing 2. The door stop bar 10 accordingly separates the receiving opening 9 into two partial receiving openings 9*a* and 9*b*. In the depth direction (z-direction), the door stop bar 10 extends over a depth of less than or equal to 12 cm. As already mentioned, it is a separate component from the inner container 4.

In the exemplary embodiment, it is provided that a partition plate 11 that is separate from the inner container 4 and also from the door stop bar 10 is arranged behind the door stop bar 10, and therefore in the depth direction between the door stop bar 10 and a rear wall. In the height direction (y-direction), the partition plate 11 is arranged at the same level as the door stop bar 10 such that, when viewed from the front side, the partition plate 11 is hidden by the door stop bar 10. The partition plate 11 is arranged in a nondestructively removable manner and separates the volume of the receiving space 5 into two partial volumes 5*a* and 5*b*.

This exemplary embodiment enables storage areas to be created in the two partial volumes 5*a* and 5*b*, in which storage areas different storage conditions can be realized. Thus, for example, the partial volume 5*b* may then be embodied as a keep-fresh zone in which a different humidity and/or a different temperature can be set independently of the other partial volume 5*a* of the receiving space 5.

On the front side, the first receiving space 5 can be closed by a number of separate doors, in the exemplary embodiment by three separate doors 12, 13, and 14. The doors 12, 13 and 14 are arranged relative to one another without overlapping and represent visible components to the front, in particular embodied in one plane relative to one another. In the exemplary embodiment, it is provided that the two doors 12 and 13 close the upper partial volume 5*a* on the front side, and the third door 14 closes the partial volume 5*b* embodied thereunder on the front side. The third door 14 is in particular a front plate of a drawer that can be withdrawn and inserted in the depth direction.

In the exemplary embodiment, when viewed in the vertical direction, a second receiving space 15 that is separated from the first receiving space 5 and represents the freezer compartment is embodied under the first receiving space 5. The inner container 4 additionally has an integrated wall by which the first receiving space 5 is separated from the second receiving space 15. The wall is integrated in the inner container 4 and in particular is also embodied as double-walled, in which case a thermally insulating material, in particular insulating foam, is introduced between said wall parts of the double wall.

The second receiving space 15 also is delimited by boundary walls, and a top wall 16 and a bottom wall 17 are provided in this case. Additionally provided in the exemplary embodiment shown here is a further door stop bar 18, which is embodied in the manner of a beam and extends vertically in a receiving opening 19 which represents a loading opening. The separate door-external door stop bar 18 is connected by a first end 18*a* to the upper boundary wall 16, and by a second end 18*b* to the lower boundary wall in the form of the base 17. The receiving opening 19 is separated into two partial receiving openings 19*a* and 19*b* by means of the further door stop bar 18. No additional partition plate, as is provided in the first receiving space 5, is arranged in this case behind the further door stop bar 18, such that the second receiving space 15 is embodied as contiguous and free of interruptions behind the door stop bar 18.

The second receiving space 15 can likewise be closed on the front side by two separate doors 20 and 21 (FIG. 1), which can be arranged so as to be pivotable on the housing 2, as is also realized in the case of the doors 12 and 13. It can also be provided that at least one of the two doors 20 and/or 21 is a front plate of a withdrawable and insertable drawer.

The household refrigeration appliance 1 additionally has a frame heating 22 (FIG. 3) by which it is possible to heat the front-side frame region against which the doors 12, 13, 14, 20 and 21 abut in the closed state. Unwanted condensation in the sealing region between the doors and the front-side frame or front-side flange is avoided as a result.

Figure 3:
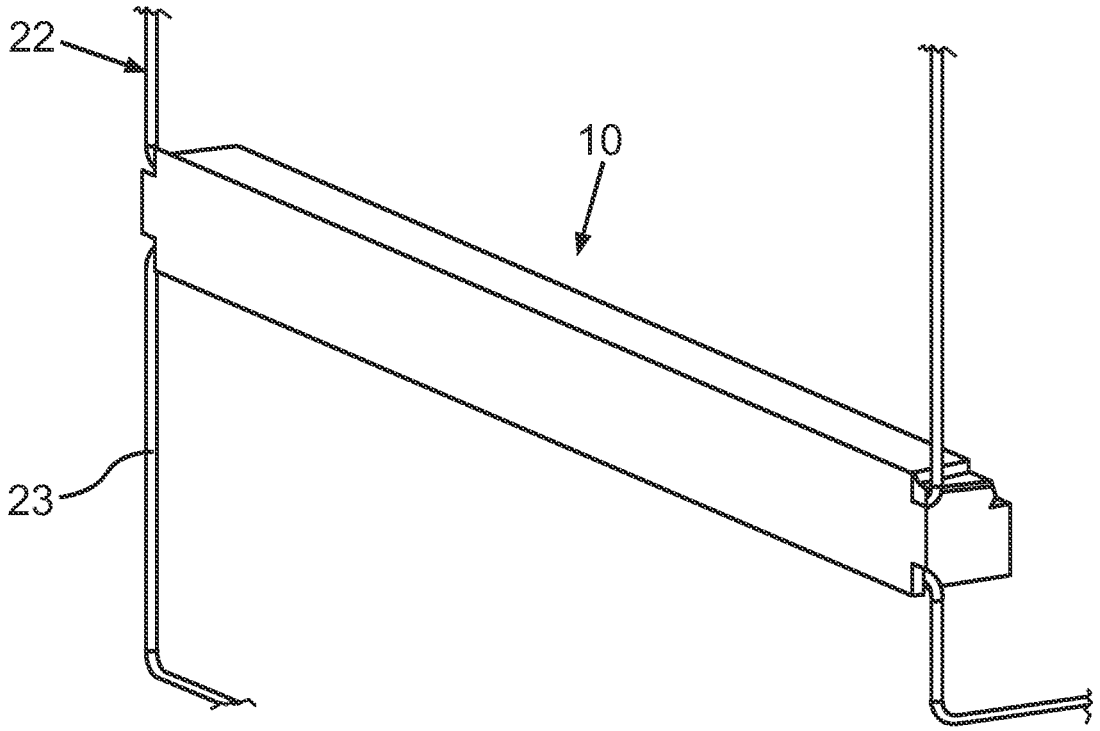
FIG. 3 is a perspective view of a door stop bar of the household refrigeration appliance according to FIG. 1 with additionally illustrated frame heating for the purpose of heating the door stop bar.

The door stop bar 10 is also shown by way of example in FIG. 3. In this context, the frame heating 22 also extends along the door stop bar 10. The same then also applies analogously to the door stop bar 18.

The frame heating 22 in the exemplary embodiment is not an electric heater, though this would also be possible, but contains at least one tubular heating line 23, in which a gaseous or liquid medium flows. In a particularly advantageous manner it is provided that the frame heating 22 is coupled to a refrigeration circuit of the household refrigeration appliance 1, such that heat accruing during the operation of the refrigeration circuit is supplied to the frame heating 22 and then the heat is utilized at the corresponding desired points of the household refrigeration appliance 1.

Figure 4:
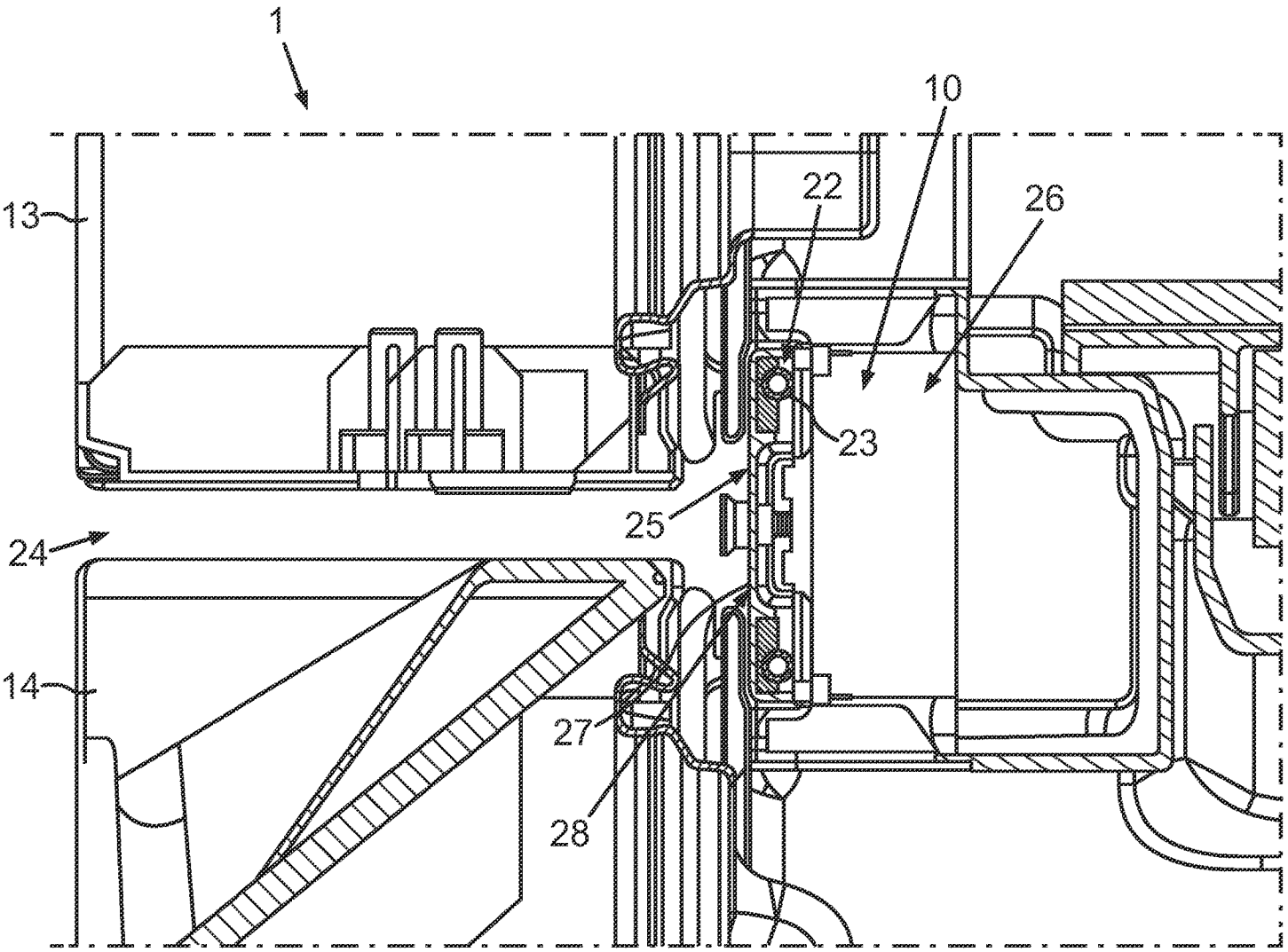
FIG. 4 is a vertical sectional view through a subsection of the household refrigeration appliance according to FIG. 1.

FIG. 4 shows the household refrigeration appliance 1 according to FIG. 1 in the region of the intersection line IV-IV. In the closed state, a gap 24 is formed between the doors 13 and 14. The door stop bar 10 is also provided in order to avoid an unwanted introduction of heat into the receiving space 5 by way of the gap 24. In the exemplary embodiment, the door stop bar 10 is embodied as a multipart component and has a front panel 25 and a thermal insulating body 26 to which the front panel 25 is secured. As can be seen, in the closed state the doors 13 and 14 abut against a front side 27 of a front plate 28 of the front panel 25. The front panel 25 can be heated by the frame heating 22.

Figure 5:
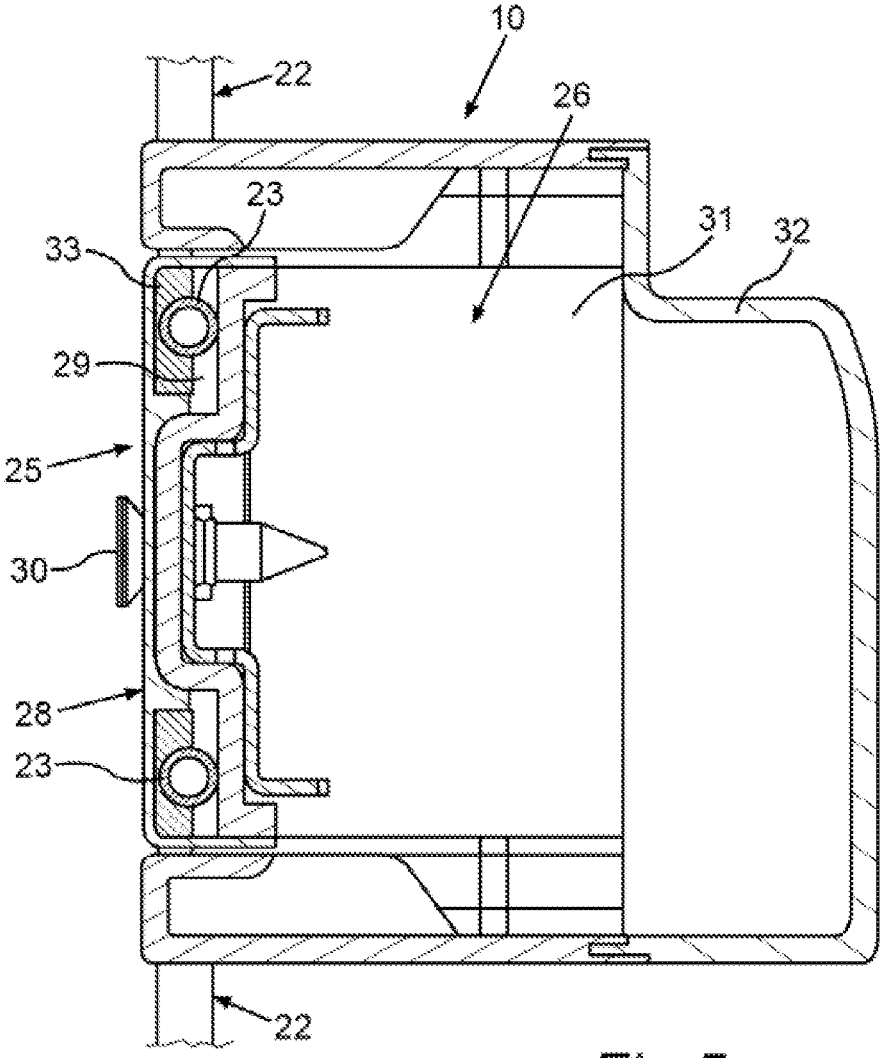
FIG. 5 is a magnified sectional view in the region of the door stop bar.

FIG. 5 shows a magnified representation in the region of the door stop bar 10. It can be seen that the front panel 25, which is integrally formed from metal in a single piece, is embodied in this vertical section in the form of a trough or channel, and in this sectional view has a C shape. The heating line 23 is in this case arranged in a cavity 29 of the C shape. The heating line 23 is furthermore installed in non-contacting relationship to the insulating body 26. In particular, the front panel 25 is screwed to the insulating body 26, a screw 30 being provided in this case. The insulating body 26 is in turn preferably embodied from two separate bar members 31 and 32 which are connected to one another, there being formed between the two bar members 31 and 32 a cavity in which a thermally insulating material is introduced. When viewed in the depth direction, the insulating body 26 with its thermally insulating material is therefore embodied between the receiving space 5 and the heating line 23.

Figure 6:
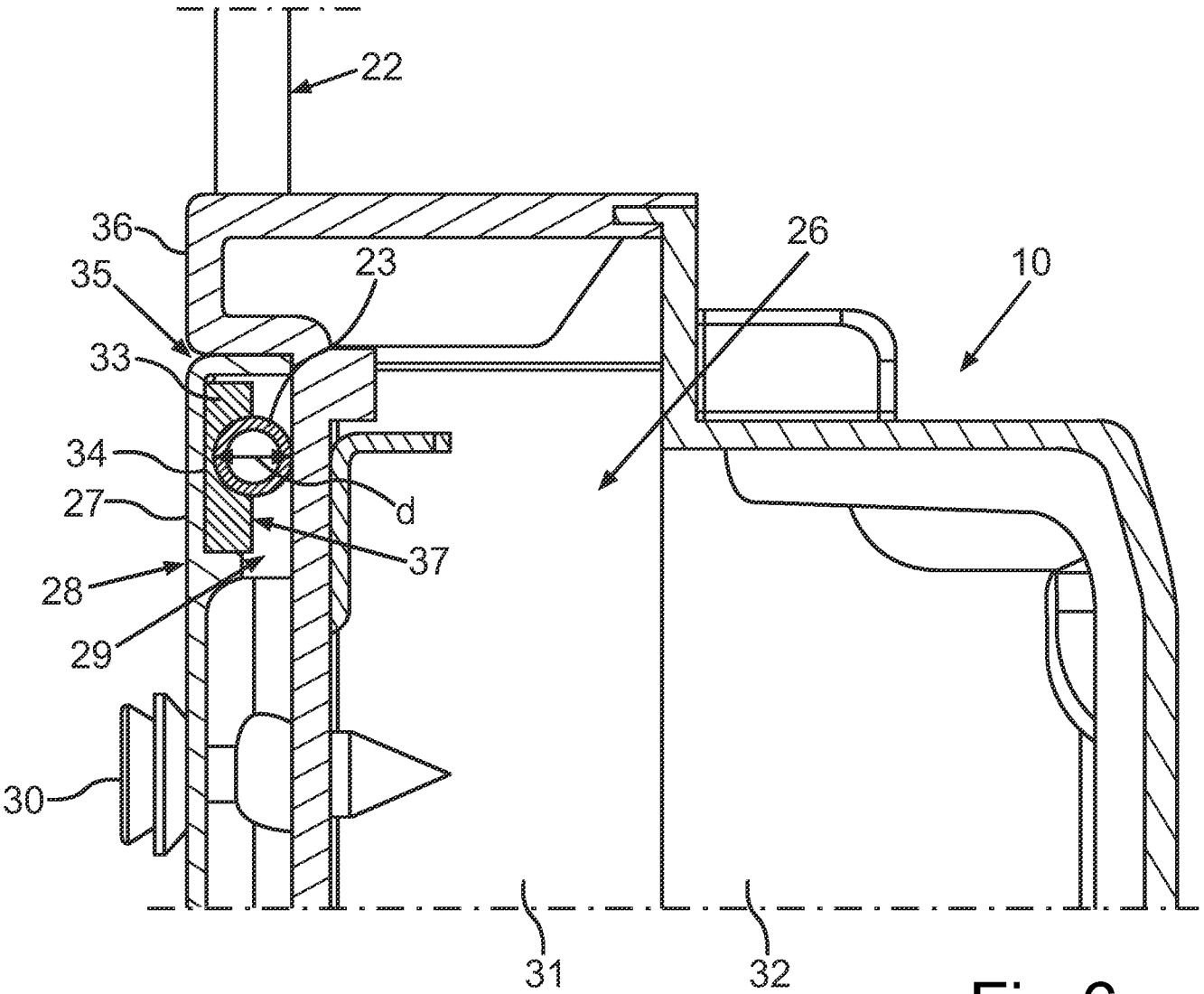
FIG. 6 is a magnified sectional view of a part shown in FIG. 4.

As can also already be seen in addition in FIG. 5, the heating line 23 is not arranged directly adjacent to the front panel 25, but rather a thermal transmission medium 33 separate therefrom and made of a solid material is arranged between the heating line 23 and the front panel 25, in particular the front plate 28. FIG. 6 additionally shows a magnified representation of a subsection in FIG. 4. It can be seen here that the thermal transmission medium 33 is arranged on an inside face 34 of the front plate 28 and additionally surrounds the heating line 23 in sections. The thermal transmission medium 33 is preferably defined as deformable and may also be embodied as paste-like. In particular, the transmission medium 33 is embodied in sections from butyl and in particular is embodied in sections as adhesive tape, preferably as double-sided adhesive tape. In particular it is provided that the heating line 23 has a diameter d, where the depth to which the heating line 23 is pressed into the transmission medium 33 or is arranged embedded therein corresponds to half of the diameter d. It can be seen that the heating line 23 is not directly in contact with the front panel 25, but is thermally coupled to the front panel 25, in particular to the front plate 28, by way of the thermal transmission medium 33 that is separate therefrom. The heating line 23 is on the other hand embodied as exposed on the rear side facing toward the insulating body 26, such that only an air space is formed here between the heating line 23 and the bar member 31.

As can also be seen in FIG. 6, the insulating body 26, in particular the first bar member 31, has a recess or indentation 35 in which the front panel 25 is arranged in an immersed manner. In particular, a flush arrangement between a front side 36 of the first bar member 31 and the front side 27 of the front plate 28 is realized in this case. A cavity is then created between the front plate 28 and the bar member 31 as a result of the specific channel shape of the front plate 28, which cavity is formed in particular by the region 29. The limbs of the C shape of the front panel 25 that are oriented in the depth direction bear on the bottom of the recess 35 of the first bar member 31, such that a certain supporting function is realized in this case too. The heating line 23 is also positioned securely as a result and an undesirable application of pressure on the bar member 31 is avoided. Furthermore, a compact configuration of the door stop bar 10 is also achieved, in particular in the depth direction, by this embodiment.

It can be provided that a foil 37 is attached on a rear side of the transmission medium 33 facing away from the front plate 28 and facing toward the bar member 31, such that the foil 37, which in particular is a metal foil, preferably an aluminum foil, is arranged between the transmission medium 33 and the heating line 23. The positioning and assembly are simplified as a result.

It can be provided that the transmission medium 33 is embodied as a coherent, continuous strip, although an arrangement of individual strip parts of the transmission medium 33, possibly arranged spaced apart from one another in the width direction, is also possible. This enables a corresponding heating of the front panel 25 to be achieved at defined local points also.

A particularly large areal contact between the heating line 23 and the transmission medium 33 on the one hand, and between the transmission medium 33 and the front panel 25 on the other hand, can be achieved by means of the embodiments, as a result of which an improvement in heat transfer is realized in comparison with line contacts. By means of the present embodiment of a door stop bar 10, 18, a significantly improved and targeted emission of heat is produced, namely directed forward and facing away from the receiving space 5, 15, and on the other hand an improved thermal insulation toward the receiving space 5, 15 is achieved as a result of the positioning of the insulating body 26 then being accomplished therebehind in the depth direction.

The following is a summary list of reference numerals and the corresponding structure used in the above description of the invention:

1 Household refrigeration appliance
2 Housing
3 Outer housing
4 Inner container
5 First receiving space
5*a* Partial volume
5*b* Partial volume
6 Boundary wall
7 Boundary wall
8 Bottom wall
9 Receiving opening
9*a* Partial receiving opening
9*b* Partial receiving opening
10 Door stop bar
10*a* First end
10*b* Second end
11 Partition plate

12 Door
13 Door
14 Door
15 Second receiving space
16 Top wall
17 Bottom wall
18 Door stop bar
18*a* First end
18*b* Second end
19 Receiving opening
19*a* Partial receiving opening
19*b* Partial receiving opening
20 Door
21 Door
22 Frame heating
23 Tubular heating lines
24 Gap
25 Front panel
26 Thermal insulating body
27 Front side
28 Front plate
29 Cavity
30 Screw
31 Bar member
32 Bar member
33 Transmission medium
35 Inside face
36 Recess
36 Front side
37 Foil
d Diameter
IV-IV Intersection line

The invention claimed is:

1. A household refrigeration appliance, comprising:

a housing defining a receiving space for foodstuffs and having a first boundary wall and a second boundary wall;

doors including a first door and a second door separate from said first door, said doors closing a front-side receiving opening of said receiving space to a front;

a door stop bar disposed externally to said doors and disposed in said receiving opening, said door stop bar having a first end connected to said first boundary wall delimiting said front-side receiving opening, and a second end connected to said second boundary wall delimiting said front-side receiving opening, wherein in a closed state said doors abut against said door stop bar on a front side, said door stop bar having a front panel and a heat-conducting transmission medium, said front panel having a C-shaped cross section with limbs;

said door stop bar having a first bar member with a recess with a bottom, said recess receiving said front panel therein with said limbs bearing against said bottom of said recess; and a frame heater disposed on said door stop bar for heating said door stop bar, said frame heater having a heating line disposed behind said front panel of said door stop bar and being thermally coupled to said front panel by means of said heat-conducting transmission medium, said heat-conducting transmission medium being disposed on an inside face of said front panel between said front panel and said heating line, said heat-conducting medium and said bottom of said recess defining an air space therebetween, said heating line having a front side embedded in said heat-conducting transmission medium and having a rear side exposed to said air space.

2. The household refrigeration appliance according to claim 1, wherein said heat-conducting transmission medium is a deformable medium.

3. The household refrigeration appliance according to claim 1, wherein:

said front panel has a front plate; and said heating line is disposed embedded over at least half of a diameter of said heating line.

4. The household refrigeration appliance according to claim 1, wherein said heat-conducting transmission medium is embodied as adhesive tape or as double-sided adhesive tape.

5. The household refrigeration appliance according to claim 1, wherein said heat-conducting transmission medium contains butyl.

6. The household refrigeration appliance according to claim 1, further comprising a foil attached on a rear side of said heat-conducting transmission medium facing away from said front panel.

7. The household refrigeration appliance according to claim 6, wherein said foil is a metal foil.

8. The household refrigeration appliance according to claim 1, wherein said front panel is made of metal.

9. The household refrigeration appliance according to claim 1, wherein said front panel has a cavity defined by said C-shaped cross section, and said heat-conducting transmission medium and said heating line are disposed in said cavity.

10. The household refrigeration appliance according to claim 9, wherein said bottom of said recess delimits said cavity.

11. The household refrigeration appliance according to claim 9, wherein said first bar member has a front surface delimiting said recess and said front panel is flush with said front surface.

12. The household refrigeration appliance according to claim 1, wherein said door stop bar is embodied in multiple parts and in addition to said front panel has a thermal insulating body.

13. The household refrigeration appliance according to claim 12, wherein:

said front panel is disposed at least in sections in an immersed manner in said recess.

14. The household refrigeration appliance according to claim 1, further comprising a partition plate being separate from said door stop bar and disposed in a depth direction of the household refrigeration appliance behind said door stop bar and at a same level as said door stop bar in a height direction of the household refrigeration appliance.

15. The household refrigeration appliance according to claim 1, wherein said door stop bar extends in a depth direction of the household refrigeration appliance to a depth of less than or equal to 12 cm.

16. The household refrigeration appliance according to claim 1, wherein said door stop bar extends in a depth direction of the household refrigeration appliance to a depth of less than or equal to 10 cm.

17. The household refrigeration appliance according to claim 1, wherein said heating line is disposed in direct contact with said bottom of said recess.

18. A household refrigeration appliance, comprising:

a housing defining a receiving space for foodstuffs and having a first boundary wall and a second boundary wall;

doors including a first door and a second door separate from said first door, said doors closing a front-side receiving opening of said receiving space to a front;

a door stop bar disposed externally to said doors and disposed in said receiving opening, said door stop bar having a first end connected to said first boundary wall delimiting said front-side receiving opening, and a second end connected to said second boundary wall delimiting said front-side receiving opening, wherein in a closed state said doors abut against said door stop bar on a front side, said door stop bar having a front panel and a heat-conducting transmission medium, said door stop bar having a first bar member with a recess with a bottom, said recess receiving said front panel therein, said door stop bar being embodied in multiple parts and in addition to said front panel having a thermal insulating body; and a frame heater disposed on said door stop bar for heating said door stop bar, said frame heater having a heating line disposed behind said front panel of said door stop bar and being thermally coupled to said front panel by means of said heat-conducting transmission medium, said heat-conducting transmission medium being disposed on an inside face of said front panel between said front panel and said heating line, said heat-conducting medium and said bottom of said recess defining an air space therebetween, said heating line having a front side embedded in said heat-conducting transmission medium and having a rear side exposed to said air space;

said thermal insulating body having a second bar member, separate from said first bar member and connected to said first bar member and together with said first bar member delimiting a cavity in which thermally insulating material is introduced.

19. The household refrigeration appliance according to claim 18, wherein said first and second bar members are made of plastic.

* * * * *